US005249931A

United States Patent [19]

Fujiwara et al.

[11] Patent Number: 5,249,931

[45] Date of Patent: Oct. 5, 1993

[54] AXIAL FLOW FLUID COMPRESSOR WITH OLDRAM COUPLING

[75] Inventors: Takayoshi Fujiwara, Kawasaki; Hisanori Honma; Yoshinori Sone, both of Yokohama; Takuya Hirayama, Fujisawa, all of Japan

[73] Assignee: Kabushiki Kaisha Toshiba, Kawasaki, Japan

[21] Appl. No.: 904,900

[22] Filed: Jun. 25, 1992

Related U.S. Application Data

[63] Continuation of Ser. No. 632,127, Dec. 20, 1990, abandoned.

[30] Foreign Application Priority Data

| | | | |
|---|---|---|---|
| Dec. 26, 1989 | [JP] | Japan | 1-337524 |
| Apr. 13, 1990 | [JP] | Japan | 2-96304 |
| Apr. 13, 1990 | [JP] | Japan | 2-98432 |
| Apr. 13, 1990 | [JP] | Japan | 2-98437 |

[51] Int. Cl.[5] ..... F04B 35/04; F04C 18/344; F04C 39/02; F16D 3/04

[52] U.S. Cl. ..... 417/356; 418/98; 418/220; 464/105

[58] Field of Search ..... 418/55.1, 55.3, 220, 418/98; 417/356, 902; 464/105

[56] References Cited

U.S. PATENT DOCUMENTS

| | | | |
|---|---|---|---|
| 2,240,178 | 4/1941 | Brace | 417/357 |
| 2,331,878 | 10/1943 | Wentworth | 417/356 |
| 3,479,960 | 11/1969 | Cardoso | 417/356 |
| 3,759,067 | 9/1973 | Perazzella | 464/105 |
| 3,789,627 | 2/1974 | Smith | 464/105 |
| 4,655,696 | 4/1987 | Utter | 418/55.3 |
| 4,871,304 | 10/1989 | Iida et al. | 418/220 |
| 4,872,820 | 10/1989 | Iida et al. | 418/220 |
| 4,875,842 | 10/1989 | Iida et al. | 418/220 |
| 4,964,786 | 10/1990 | Maerens | 417/902 |
| 5,026,264 | 6/1991 | Morozumi et al. | 418/220 |

FOREIGN PATENT DOCUMENTS

| | | | |
|---|---|---|---|
| 416224 | 3/1991 | European Pat. Off. | 418/220 |
| 2176185 | 7/1990 | Japan . | |
| 2176189 | 7/1990 | Japan . | |
| 2-201088 | 8/1990 | Japan | 418/220 |
| 2-259293 | 10/1990 | Japan | 418/220 |

*Primary Examiner*—John J. Vrablik

*Attorney, Agent, or Firm*—Cushman, Darby & Cushman

[57] ABSTRACT

A compressor includes a cylinder, and a rotating body located in the cylinder. A spiral groove is formed on the outer periphery of the rotating body. A spiral blade is fitted in the groove and divides the space between the inner periphery of the cylinder and the outer periphery of the rotating body into operating chambers which have volumes gradually decreasing with distance from one end of the cylinder. A drive motor rotates the cylinder and the rotating body relative to each other. The drive motor includes a cylindrical stator fixed on a closed casing and a rotor mounted on the cylinder and situated inside the stator coaxially, with a motor air gap provided therebetween. A main bearing is engaged with the axial end portion of the cylinder and fixed on the inner wall of the casing by means of a fixing member situated radially more inward than the stator. The main bearing is fixed on the closed casing, with the position of the main bearing adjusted by a master rotor.

21 Claims, 16 Drawing Sheets

AXIAL FLOW FLUID COMPRESSOR WITH OLDRAM COUPLING

This is a continuation of application Ser. No. 07/632,127, filed on Dec. 20, 1990, which was abandoned upon the filing hereof.

BACKGROUND OF THE INVENTION

1. Field of the Invention

The present invention relates generally to an axial flow fluid compressor and a method of assembling the same.

2. Description of the Related Art

For example, in a rotary compressor, a frame is fixed on the inner wall of a casing, and a main bearing is attached to the frame. The frame is fixed on the inner wall of the casing by means of, e.g. shrinkage fit.

FIGS. 28 and 29 show examples of an axial flow fluid compressor (hereinafter, referred to as "compressor"). The compressor of FIG. 28 is disclosed in U.S. Pat. No. 4,871,304, and that of FIG. 29 is disclosed in U.S. Pat. No. 4,875,842.

As is shown in FIGS. 28 and 29, this type of compressor 111 has a compression section 3 disposed within a sealed casing (hereinafter, called "casing") 2. The compression section 3 comprises a cylinder 7 having both ends opened in its axial direction, and a rotating rod 8 situated eccentrically within the cylinder 7.

Further, a main bearing 15 and a sub bearing 16 hermetically seal the opened ends of the cylinder 7. A main shaft 12 and a sub shaft 13 are inserted into the main bearing 15 and sub bearing 16.

A spiral blade 9 is formed on the peripheral surface of the rotating rod 8. The inside space of the cylinder 7 is divided by the blade 9 into a plurality of working chambers. The working chambers have volumes decreasing gradually from the suction side towards the discharge side.

The cylinder 7 and the rotating body 8 are rotated relative to each other and synchronously by a drive motor 4. The motor 4 comprises a stator 17 fixed on the inner wall of the casing, and a rotor 18 mounted on the cylinder 7 and situated inside the stator 17 so as to be coaxial with the stator 17. A refrigerant gas is compressed by the compression section 3 while it is carried gradually from the suction side to the discharge side of the cylinder 7.

In the compressor 111 of the type wherein the refrigerant gas is compressed while it is carried, if the main bearing 15 is attached to a frame 112, as in the rotary compressor as shown in FIG. 30, an unnecessary space 113 is produced outside the frame 112. As a result, the axial dimension of the casing 2 is increased by the space 113, and the size of the compressor 111 is also increased.

Such an unnecessary space in the casing can be eliminated, if the main bearing 15 is directly fixed on the bottom face of the casing 2 by means of adhesion or welding, as shown in FIGS. 28 and 29. Thus, the increase in size of the compressor 111 can be prevented.

In the compressor 111 shown in FIGS. 28 and 29 wherein the main bearing is directly attached to the casing 2, however, it is difficult to make the axis of the main bearing 15 coincide with the axis of the stator 17 at the time of assembly, though the size of the compressor 111 can be reduced.

In other words, in the compressor 111 shown in FIGS. 28 and 29, it is difficult to keep the squareness of the main bearing 15 in relation to the motor 4. If the axis of the main bearing 15 and stator 17 do not coincide, a motor air gap 19 provided by virtue of a difference between the inside diameter of the stator 17 and the outside diameter of the rotor 18 becomes eccentric. It is thus difficult to keep the entire air gap 19 precisely.

In order to keep the motor air gap 19 at a predetermined value, it is necessary to precisely determine the locations where the main bearing 15 and stator 17 are to be fixed, and the positional relationship between the main bearing 15 and the stator 17.

In addition, it is difficult to fix the main bearing 15 to the casing 2.

SUMMARY OF THE INVENTION

The object of the present invention is to provide an axial flow fluid compressor with high durability and reliability, which can be assembled easily and precisely, and an assembling method applicable to this compressor.

According to an aspect of the present invention, there is provided an axial flow fluid compressor comprising: a casing; a cylinder situated within the casing and having both end portions serving serving as a suction-side end portion and a discharge-side end portion; a rotating body having on its outer peripheral surface a spiral groove formed with a gradually decreasing pitch, the rotating body being situated eccentrically within the cylinder; a spiral blade fitted in said spiral groove and wound around the rotating body, the spiral blade having an outer peripheral surface put in contact with an inner peripheral surface of the cylinder, and the spiral blade forming a plurality of working chambers within the cylinder, which chambers have volumes gradually decreasing from the suction side towards the discharge side; a drive motor for rotating the cylinder and the rotating body relative to each other, the drive motor including a cylindrical stator fixed on the casing and a rotor mounted on the cylinder and situated inside the stator coaxially, with a motor air gap provided therebetween; and a bearing member engaged with the axial end portion of the cylinder and fixed on the inner wall of the casing by means of a fixing member situated radially more inward than the stator.

According to another aspect of the invention, there is provided an axial flow fluid compressor comprising: a casing; a cylinder situated within the casing and having axial end portions, one of the end portions serving as a suction-side end portion and the other serving as a discharge-side end portion; a bearing member engaged with one of the axial end portions of the cylinder; a rotating body having on its outer peripheral surface a spiral groove formed with a gradually decreasing pitch, the rotating body being situated eccentrically within the cylinder; a spiral blade fitted in said spiral groove and wound around said rotating body, the spiral blade having an outer peripheral surface put in contact with an inner peripheral surface of the cylinder, and the spiral blade forming a plurality of working chambers within the cylinder, which chambers have volumes gradually decreasing from the suction side towards the discharge side; a drive motor for rotating the cylinder and the rotating body relative to each other, the drive motor including a cylindrical stator fixed on the casing and a rotor mounted on the cylinder and situated inside the stator coaxially, with a motor air gap provided therebetween; and a support member formed of a disc-like plate member and coupled to said bearing member, a plate surface of said support member being fixed on an axial end face of the casing along a line perpendicular to the axis of the casing.

According to still another aspect of the invention, there is provided a method of assembling an axial flow fluid compressor, comprising: a first step wherein a master rotor having an outside diameter determined such that the outer peripheral surface of the master rotor comes into contact with the inner peripheral surface of a stator, and having a recess for engagement with a bearing member, the inner peripheral surface of the recess being designed to come into contact with the outer peripheral surface of the bearing member, is inserted into the inside of the stator, the master rotor is engaged with the bearing member, and the position of the bearing member is adjusted to make the axis of the bearing member coincide with the axis of the stator; and a second step wherein the bearing member is fixed on a casing, with the position of the bearing member adjusted by the master rotor.

DETAILED DESCRIPTION OF THE PREFERRED EMBODIMENTS

Embodiments of the present invention will now be described with reference to the accompanying drawings.

Figure 1:
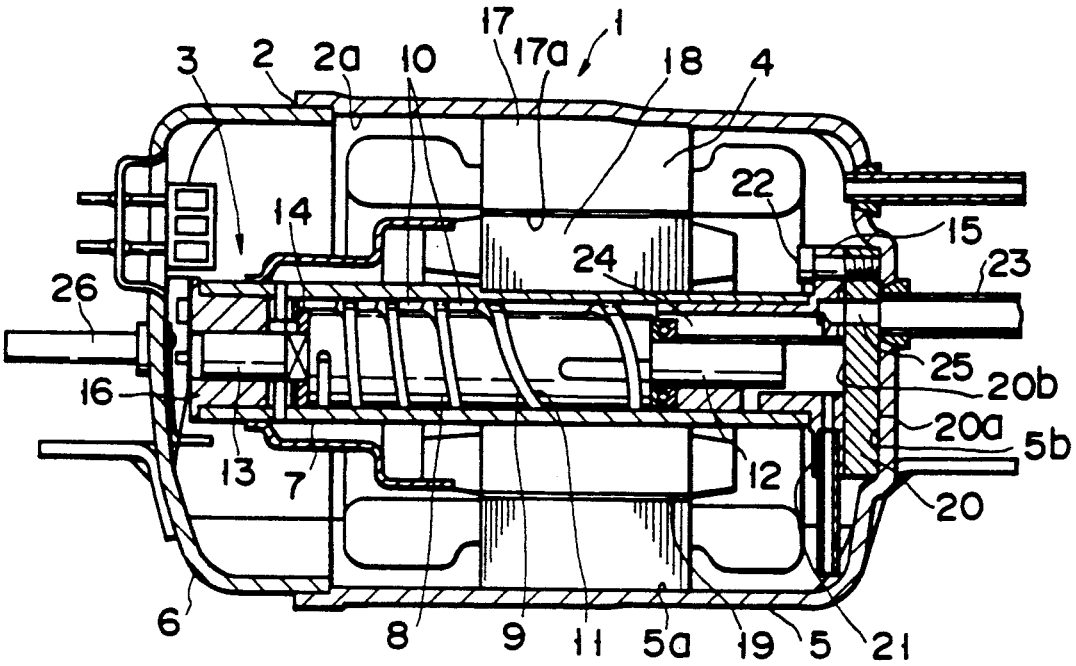
FIG. 1 is a cross-sectional side view showing a first embodiment of the invention.

FIG. 1 shows a first embodiment of the invention. An axial flow fluid compressor (hereinafter "compressor") 1 is employed, for example, in a refrigerating cycle. The compressor 1 comprises a cylindrical sealed casing 2, a compression section 3 housed in the casing 2, and a drive motor 4 situated coaxially with the compression section 3 to rotate the compression section 3.

The sealed casing 2 comprises a first casing 5 having an opened axial end and a second casing 6 having an opened axial end. The sealed casing 2 is constituted by hermetically coupling the first and second casings 5 and 6, with their opened ends facing each other coaxially.

The compression section 3 comprises a cylinder 7 and a rotating body 8 situated eccentrically within the cylinder 7. A spiral blade 9 is formed on the rotating body 8 of the compression section 3. A plurality of working chambers 10 divided by the blade 9 are formed in the cylinder 7.

The rotating body 8 has a spiral groove 11 on its outer peripheral surface. The groove 11 extends with a predetermined pitch varying from one side to the other side of it. The rotating body 8 has a main shaft 12 and a sub shaft 13 at their axial ends. The shafts 12 and 13 are thinner than the middle portion of the rotating body 8. The spiral blade 9 having a suitable elasticity is forcibly fitted in the groove 11 of the rotating body 8.

The cylinder 7 has axial ends opened. One of the opened ends is located on the suction side, and the other is located on the discharge side. The cylinder 7 contains the rotating body 8 and the blade 9, such that the blade 9 is contracted to some extent towards the center of the spiral of the blade 9. In addition, the cylinder 7 has its inner peripheral surface brought into hermetical contact with part of the outer peripheral surface of the rotating body 8.

The cylinder 7 contains a plurality of working chambers 10 divided by the blade 9. The working chambers 10 have volumes varying gradually from one axial end to the other axial end of the cylinder 7.

In the compression section 3, the working chambers 10 are arranged along the axis of the cylinder 7. The volumes of the chambers 10 decrease gradually from the suction side (the right side in FIG. 1) of the cylinder 7 towards the discharge side (the left side).

The cylinder 7 of the compression section 3 includes an Oldham mechanism 14 for transmitting a torque of the cylinder 7 to the rotating body 8. A main bearing 15 is hermetically inserted into the suction-side end of the cylinder 7, and a sub bearing 16 is hermetically inserted into the discharge-side end of the cylinder 7. The main shaft 12 of the rotating body 8 is inserted into the main bearing 15, and the sub shaft 13 is inserted into the sub bearing 16. The both bearings 15 and 16 enable the rotating body 8 to rotate.

The drive motor 4 comprises an annular stator 17 fixed on the inner peripheral surface 5*a* of the first casing 5, and an annular rotor 18 situated coaxially within the stator 17 and mounted on an intermediate part of the cylinder 7. A motor air gap 19 is produced between the stator 17 and the rotor 18 by utilizing a difference between the inside diameter of the stator 17 and the outside diameter of the rotor 18.

In FIG. 1, a main bearing seat 20 serves as a support for the main bearing 15. The seat 20 is a circular plate. One surface 20*a* of the seat 20 is fixed on a bottom face 5*b* of the first casing 5 of the sealed casing 2. The axis of the main bearing seat 20 is substantially parallel to the axis of the casing 2. The other surface 20*a* of the seat 20, which is exposed to the drive motor 4, is flattened with high precision. The surface 20*b* is substantially perpendicular to the inner peripheral surface 2*a* of the casing 2, that is, substantially perpendicular to the axis of the casing 2.

Figure 2:
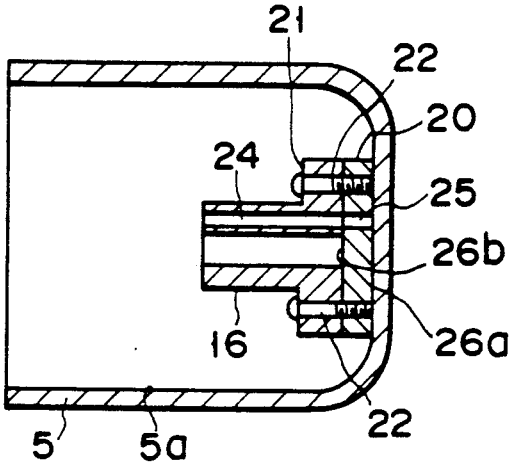
FIG. 2 is a cross-sectional side view showing the state wherein a main bearing is attached in the first embodiment.
Figure 3A:
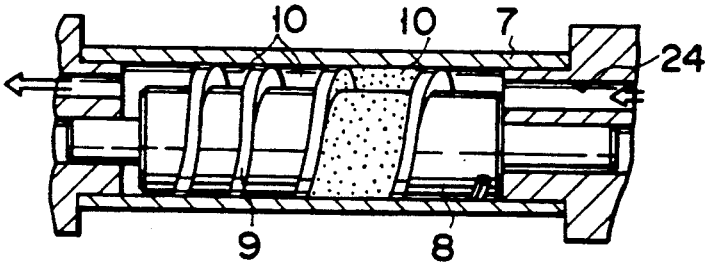
FIGS. 3A to 3D are cross-sectional side views illustrating the process of compressing a refrigerant gas while it is carried.
Figure 3B:
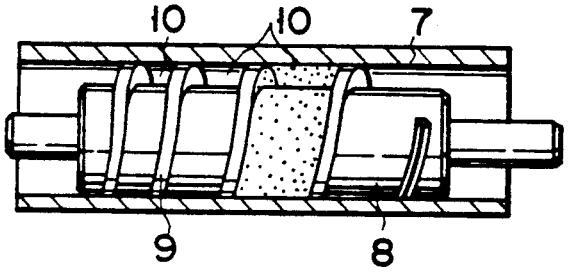
Figure 3C:
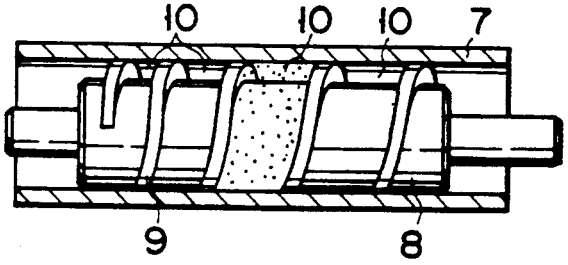
Figure 3D:
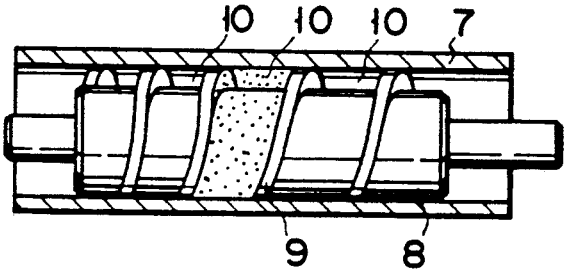

As is shown in FIGS. 1 and 2, the exposed surface 20*b* of the main bearing seat 20 is put in contact with the main bearing 15. The surface 20*b* is superposed on a flange 21 of the main bearing 15 projecting radially outwards. The main bearing seat 20 is coupled to the main bearing 15 by means of bolts 22 inserted through the flange 21 in its thickness direction.

The bolts 22 are arranged about the axis of the main bearing 15, along a circle with a diameter smaller than the diameter of the inner peripheral surface of the stator 17. The bolts 22 are situated radially inwards of the inner peripheral surface of the stator 17.

The main bearing seat 20 supports the compression section 3 at its one side, and the axis of the compression section 3 (and the rotor 18) is made to coincide with the axis of the stator 17.

The main bearing seat 20 has a suction gas passage 25 extending in the thickness direction of the main bearing seat 20 and allowing a suction pipe 23 connected to the bottom of the first casing 5 from the outside to communicate with a suction hole 24 formed in the main bearing 15.

In order to seal the suction gas path 25 from the pressurized gas discharged into the sealed casing 2, it is desirable that the main bearing seat 20 be fixed to the first casing 5 by means of a ring welding along the outer peripheral surface of the main bearing seat 20.

The bolts 22 are fastened while a predetermined motor air gap 19 is kept in the circumferential direction, thereby coupling the main bearing 15 (and compression section 3) to the main bearing seat 20.

In FIG. 1, numeral 26 denotes a discharge pipe connected to the first casing 5 from the outside. The pressurized refrigerant gas in the sealed casing 2 is discharged from the casing 2 to the outside through the discharge pipe 26.

In the compressor 1 having the above structure, the drive motor 4 is driven to rotate the rotor 18 and the cylinder 7 coaxially, as one body. The torque of the cylinder 7 is transmitted to the rotating body 8 through the Oldham mechanism 14. The rotating body 8 is rotated synchronously with the cylinder 7, such that part of the outer peripheral surface of the rotating body 8 is put in contact with the inner peripheral surface of the cylinder 7.

The blade 9 is displaced relative to the rotating body 8, in accordance with the rotation of the rotating body 8. The blade 9 is projected from and retreated in the groove 11 in the radial direction of the rotating body 8, such that the outer peripheral surface of the blade 9 is put in contact with the inner peripheral surface of the cylinder 7 and part of the blade 9 is projected from the groove 11.

When the compression section 3 is operated, a refrigerant gas in a refrigerating cycle is taken in the cylinder 7 through the suction pipe 23, suction gas path 25 and suction hole 24. As is illustrated in FIGS. 3A to 3D, the refrigerant gas taken in the cylinder 7 is successively sent to the working chambers 10 in accordance with the relative movement of the cylinder and the rotating body 8. The refrigerant gas is gradually compressed as it sent from the suction side to the discharge side of the cylinder 7.

The refrigerant gas pressurized in the cylinder 7 is discharged to the inside space of the sealed casing 2, and is returned to the refrigerating cycle through the discharge pipe 26.

Figure 30:
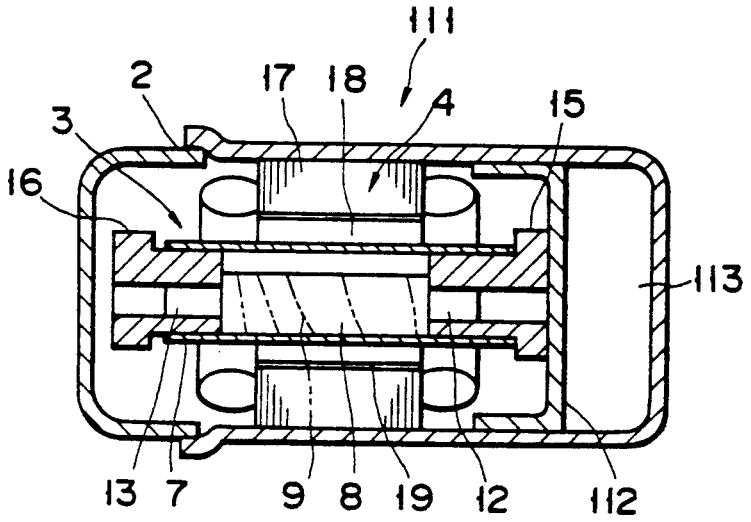
(PRIOR ART) FIG. 30

In the above compressor 1, the main bearing 15 is fixed to the sealed casing 2, without providing the frame 112 as shown in FIG. 30. Thus, the unnecessary space 113 does not be produced outside the frame 112. As a result, the axial length of the compressor 1 is small and the size of the compressor 1 can be reduced.

Since the main bearing 15 (and compression section 3) is supported via the main bearing seat 20, the surface to which the main bearing 15 is attached, i.e. the exposed surface 20*b* of the main bearing seat 20 can easily kept at right angles to the inner peripheral surface 2*a* of the sealed casing 2. Thus, the motor air gap 19 can be kept at a predetermined dimension over the entire circumference of the rotor 18.

In addition, the main bearing 15 can easily be fixed to the main bearing seat 20 by means of the bolts 22.

Figure 4:
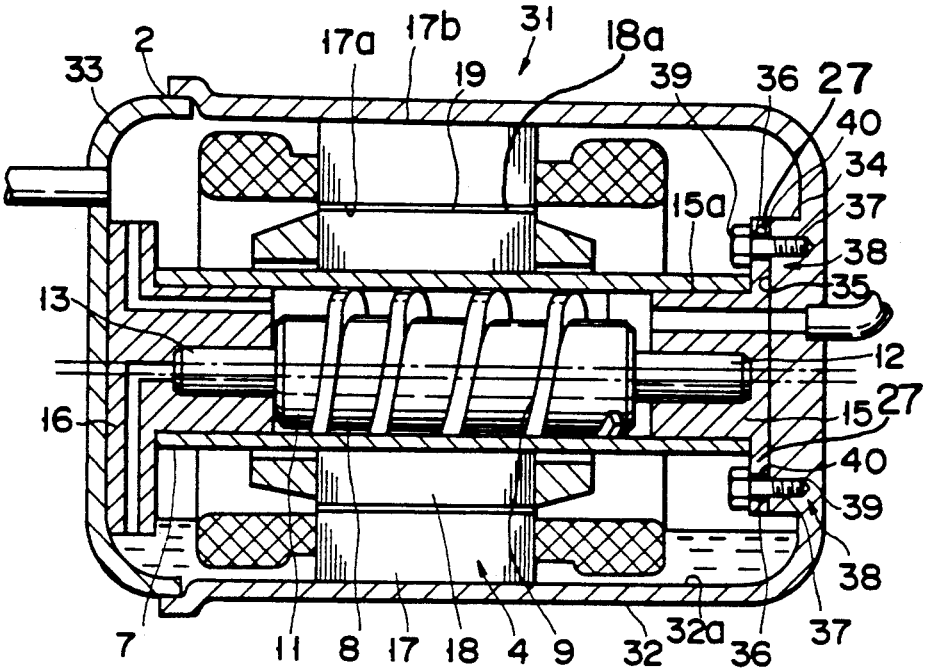
FIG. 4 is a cross-sectional side view showing a second embodiment of the invention.

FIG. 4 shows a second embodiment of the present invention. The structural elements, which have already been mentioned in the first embodiment, are denoted by like reference numerals, and the description thereof is omitted.

In FIG. 4, an axial flow fluid compressor (hereinafter called "compressor") 31 is employed, for example, in a refrigerating cycle. The compressor 31 comprises a cylindrical sealed casing 2, a compression section 3 housed in the casing 2, and a drive motor 4 situated coaxially with the compression section 3 to rotate the compression section 3.

The sealed casing 2 comprises a first casing 32 having an opened axial end and a second casing 33 having an opened axial end. The sealed casing 2 is constituted by hermetically coupling the first and second casings 32 and 33, with their opened ends facing each other coaxially.

A main bearing seat 34 is projected from the central part of the bottom of the first casing 32. The main bearing seat 34 is formed integral with the first casing 32. The main bearing seat 34 has, for example, a substantially circular shape. A receiving surface 35 of the main bearing seat 34 is flattened with a desired precision. The receiving surface 35 is directed to the open side of the first casing 32, while the surface 35 is kept substantially perpendicular to the axis of the first casing 32.

The compression section 3 comprises a cylinder 7 and a rotating body 8 (or a columnar rotating body) situated eccentrically within the cylinder 7. The cylinder 7 contains a plurality of working chambers 10 divided by a spiral blade 9 formed around the rotating body 8. The blade 9 is fitted in a spiral groove 11 cut in the peripheral surface of the rotating body 8. The working chambers 10 have volumes decreasing gradually from the suction side towards the discharge side of the cylinder 7.

A main bearing 15 is hermetically inserted into a suction-side end portion of the cylinder 7, and a sub bearing 16 is hermetically inserted into a discharge-side end end portion of the cylinder 7. A main shaft 12 of the rotating body 8 is inserted into the main bearing 15, and a sub shaft 13 of the rotating body 8 is inserted into the sub bearing 16. The bearings 15 and 16 support the rotating body 8 rotatably.

An outer end face of the main bearing 15 is abutted on the receiving surface 35 of the main bearing seat 34. A flange 27 of the main bearing 15, which projects radially outwards, is superposed on the main bearing seat 34. The flange 27 has through-holes 36 extending in the thickness direction of the flange 27. The through-holes 36 are opposed to tap holes 37 formed in the main bearing seat 34, such that the through-holes 36 communicate with the tap holes 37.

The through-holes 36 and tap holes 37 constitute bolt holes 38 (only two of which are shown) extending over the flange 27 and the main bearing seat 34. The holes 36 and 37 are positioned to correspond to each other.

The tap holes 37 extend in the thickness direction of the main bearing seat 34. The holes 37 are open to the receiving surface 35 and extends to a predetermined depth in the bottom of the first casing 32.

The diameter of each through-hole 36 is slightly greater than that of each tap hole 37.

The drive motor 4 comprises an annular stator 17 fixed on the inner peripheral surface 32*a* of the first casing 32, and an annular rotor 18 situated coaxially within the stator 17 and mounted on a intermediate part of the cylinder 7. A motor air gap 19 is produced between the stator 17 and the rotor 18 by utilizing a difference between the inside diameter of the stator 17 and the outside diameter of the rotor 18.

The stator 17 includes coaxially formed inner peripheral surface 17*a* and outer peripheral surface 17*b*. The axis of the stator 17 is substantially identical to the axis of the sealed casing 2. The rotor 18 fixed on the outer peripheral surface of the cylinder 7 is located inside the stator 17. A motor air gap 19 is provided between the inner peripheral surface 17*a* of the stator 17 and the outer peripheral surface 18*a* of the rotor 18.

In FIG. 4, numeral 39 denotes bolts serving as fixing members. The bolts 39 are engaged in the bolt holes 38. The bolts 39 securely couple the main bearing 15 (and compression section 3) to the first casing 32. A gap 40 is provided between each bolt 39 and the inner peripheral surface of the corresponding through-hole 36.

The bolts 39 are arranged about the axis of the main bearing 15, along a circle having a diameter less than the diameter of the inner peripheral surface 17*a* of the stator 17. The bolts 39 are located inside the inner peripheral surface 17*a* of the stator 17.

Figure 5:
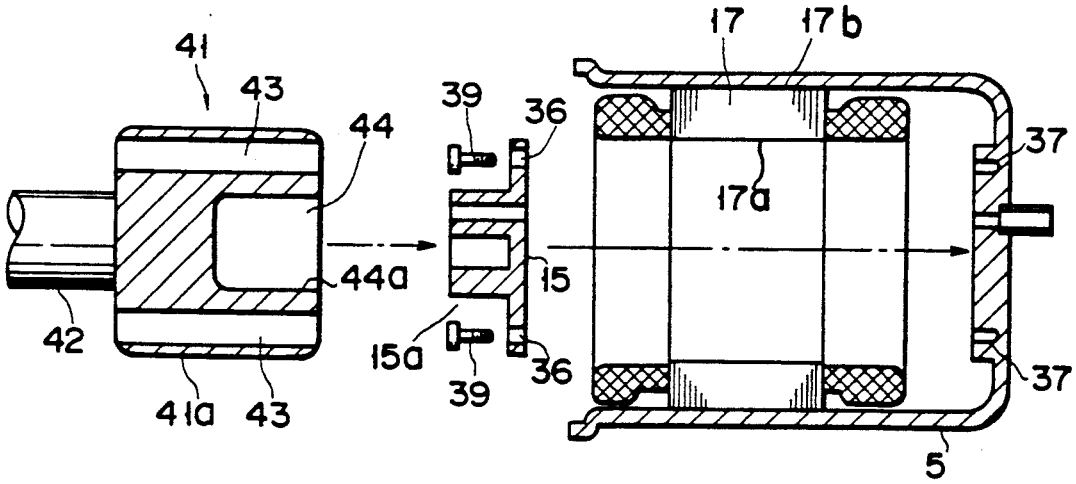
FIG. 5 is a view for illustrating how to assemble the fluid compressor according to the second embodiment.

The compressor 1(31) having the above structure is assembled with use of a master rotor denoted by numeral 41 in FIG. 5.

The master rotor 41 has a columnar shape and is attached to an end portion of a shaft 42. The outside diameter of the master rotor 41 is substantially equal to the inside diameter of the stator 17. The master rotor 41 extends straight and has both ends opened. The master rotor 41 has working holes 43, for example, arranged coaxially so as to correspond to the bolt holes 88. In addition, the master rotor 41 has a recess 44 in which the main bearing (bearing member) is engaged. The recess 44 is formed at a central part of an end portion of the master rotor 41 and has an inside diameter substantially equal to the outside diameter of the main bearing 15.

The compressor 31 is formed in the following manner.

The main bearing 15 is temporarily attached, by means of the bolts 39, to the main bearing seat 34 of the first casing 32 to which the stator 17 is fixed in advance. The master rotor 41 is inserted into the first casing 32. The master rotor 41 is inserted into the inside space of the stator 17 such that an outer peripheral surface 41*a* of the master rotor 41 is brought into contact with the inner peripheral surface 17*a* of the stator 17.

The end portion of the master rotor 41 is engaged with the main bearing 15, and the main bearing 15 enters the recess 44. The inner peripheral surface 44*a* of the recess 44 is put in contact with the outer peripheral surface of the main bearing 15. The position of the main bearing 15 is adjusted in relation to the stator 17, so that the axis of the main bearing 15 may coincide with the axis of the stator 17.

While the position of the main bearing 15 is kept, a tool or the like is inserted into the working holes 43 of the master rotor 41. The bolts 39 are fastened with sufficient force; thus, the main bearing 15 is secured to the first casing 42.

After the master rotor 41 is pulled out from the first casing 32, the cylinder 7, rotating body 8, etc. are assembled with the main bearing 15. Thus, the compression section 3 is constituted.

By virtue of the gap 40 defined inside the inner peripheral surface of the through-hole 36, the main bearing 15 is engaged with the master rotor 41 and simultaneously the main bearing 15 is automatically positioned in a plane vertical to the axis of the master rotor 41. The main bearing 15 supports the cylinder 7, rotor 18, etc. in the state wherein the axes thereof coincide with the axis of the stator 17.

According to the above compressor 31 and the method of assembling the compressor 31, the axis of the stator 17 can be made to coincide with the axis of the main bearing 15 (and cylinder 7, rotor 18, etc.) with high precision. Thus, the motor air gap 19 is not varied and can be kept at a constant value in the circumferential direction.

Since the position of the main bearing 15 is adjusted with use of the master rotor 41, it is easy to make the axis of the main bearing 15 coincide with the axis of the stator 17.

Since the bolts 39 are arranged inside the inner peripheral surface 17*a* of the stator 17, it is possible to fix the main bearing 15 while adjusting the position of the main bearing 15 with use of the master rotor 41.

Further, since the motor air gap 19 can be kept constant, the input to the motor is stable, and the performance of the drive motor 4 is enhanced.

Since the motor air gap 19 does not become eccentric, non-uniform rotation of the rotating body 8 does hardly occur, and the vibration of the compressor 31 is low.

Figure 6:
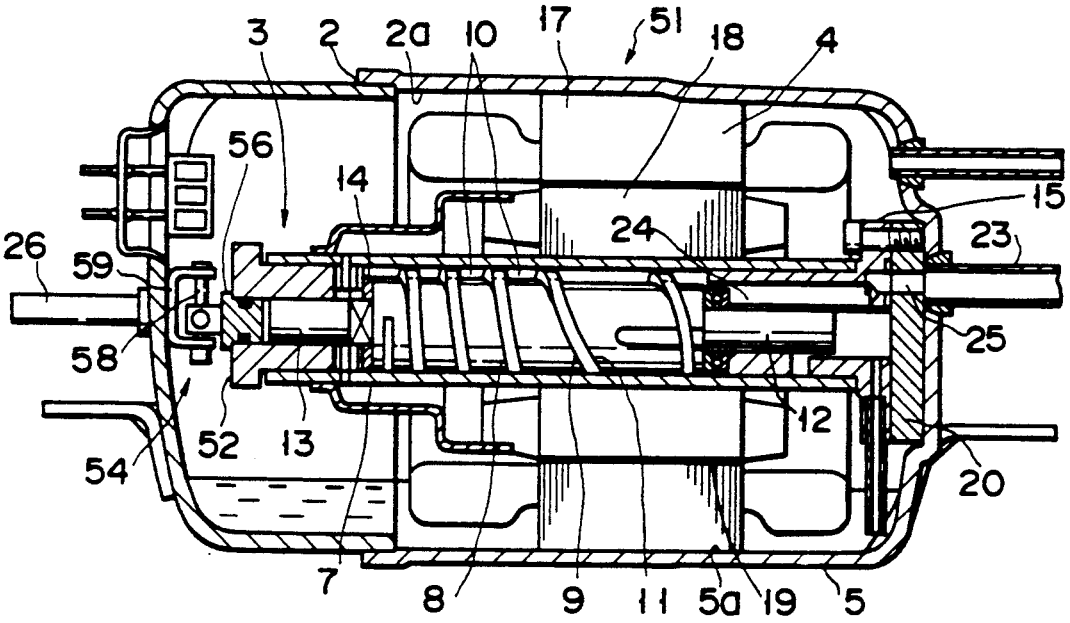
FIG. 6 is a cross-sectional side view showing a third embodiment of the invention.

FIG. 6 shows a third embodiment of the invention. The structural elements, which have already been mentioned above, are denoted by like reference numerals, and the description thereof is omitted.

In FIG. 6, numeral 51 denotes an axial flow fluid compressor (hereinafter, referred to as "compressor").

The compressor 51 comprises a sealed casing 2, and a compression section 3 contained within the sealed casing 2. The compression section 3 is constituted by a cylinder 7 having both ends opened, and a rotating rod 8 situated eccentrically within the cylinder 7.

A main shaft 12 and a sub shaft 13 are integrally formed at both end portions of the rotating body 8 of the compression section 3. The main shaft 12 and sub shaft 13 are rotatably supported by a main bearing (suction-side bearing) 15 and a sub bearing (discharge-side bearing) 52 (described later) at eccentric positions of the bearings 15 and 52.

The main bearing 15 and sub bearing 52 are inserted into both open ends of the cylinder 7. The both open ends of the cylinder 7 are hermetically sealed. The main bearing 15 is fixed on the inner wall of the sealed casing 2, and the sub bearing 52 is left free. More specifically, the cylinder 7, along with the rotating body 8, is supported at one side by the main bearing 15 within the sealed casing 2.

A spiral groove 11 is formed in the outer peripheral surface of the rotating body 8. A blade 9 is fitted in the groove 11 such that the blade 9 can freely project from and sink in the groove 11. The inside space of the cylinder 7 is divided by the blade 9 into a plurality of working chambers 10. The working chambers 10 have volumes decreasing gradually from the suction side towards the discharge side of the cylinder 7.

In the compressor 51, a drive motor 4 rotates the cylinder 7 and rotating body 8 relative to each other and synchronously, thereby compressing a refrigerant gas (working fluid) or the like sent from a refrigerating cycle while carrying the gas gradually from the suction side towards the discharge side of the cylinder 7.

Figure 7:
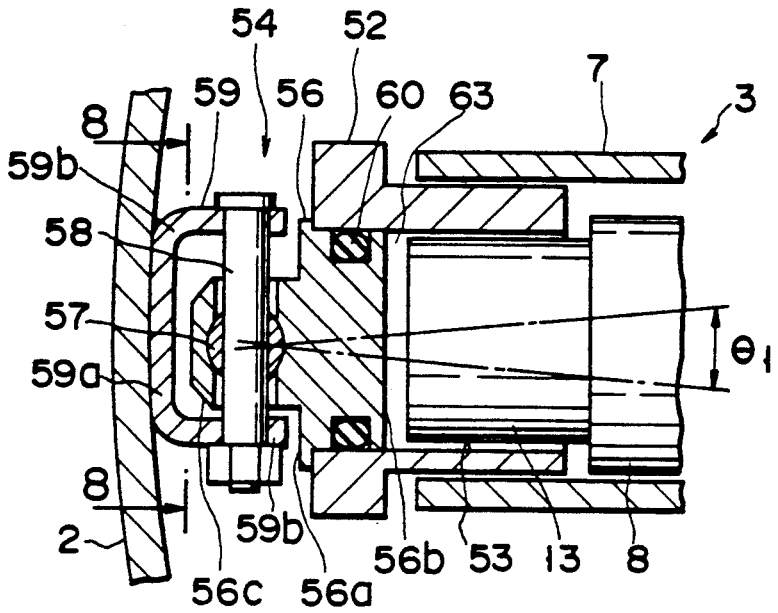
FIG. 7 is a cross-sectional side view showing a sub bearing, a support mechanism and peripheral parts thereof in the third embodiment.
Figure 8:
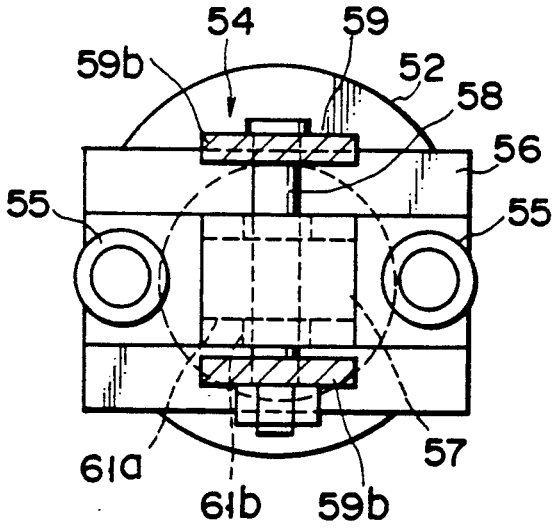
FIG. 8 is a cross-sectional view taken along line VIII—VIII in FIG. 7.
Figure 9:
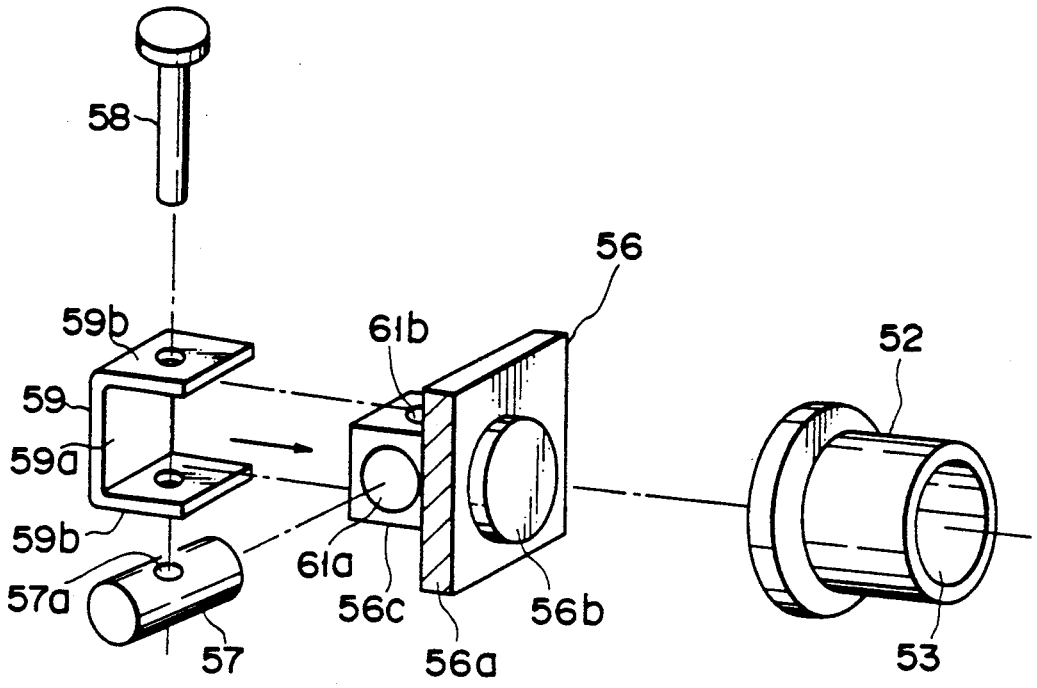
FIG. 9 is an exploded perspective view showing a sub bearing and a support mechanism.

As is shown in FIGS. 7 to 9, the sub bearing 52 has a cylindrical shape with a stepped portion. That portion of the sub bearing 52 which has a smaller diameter is inserted into the cylinder 7, and that portion having a larger diameter is projected from the cylinder 7.

The sub bearing 52 has a support hole 53. The support hole 53 is formed so as to penetrate the sub bearing 52 eccentrically, and is eccentric with respect to the axis of the sub bearing 52. The sub shaft 13 of the rotating body 8 is supported in the support hole 53.

The sub bearing 52 is supported by the sealed casing 2 via a support mechanism 54 (described later).

Specifically, the support mechanism 54 serves to support the discharge side of the compression section 3 within the sealed casing 2.

The support mechanism 54 comprises an engagement cap 56 fixed to the sub bearing 52 by means of engagement screws 55; a columnar slide pin 57 loosely inserted into the engagement cap 56; a columnar support pin 58 crossing the slide pin 57 substantially at right angles; and a support member 59 for fixing both end portions of the support pin 58 to the sealed casing 2.

The structural parts of the support mechanism 54 will now be described.

The engagement cap 56 comprises a flange **56*a* fixed on the end face of the sub bearing 52 by means of the engagement screws 55; a disc portion 56*b* formed integrally with one end face of the flange 56*a*, engaged in the support hole 53 in the sub bearing 52, and designed to hermetically seal the support hole 53 with use of a seal member such as a O-ring 60; and a pin stopper 56*c* integrally formed with the other end face of the flange 56*a***.

The pin stopper **56*c* has a substantially cubic shape, and projects outside of the outer end face of the sub bearing 52. The pin stopper 56*c* has pin stopper holes 61*a* and 61*b* extending in the horizontal and vertical directions and having different diameters. The pin stopper holes 61*a* and 61*b*** intersect at right angels with each other.

The point of intersection of the pin stopper holes **61*a* and 61*b* coincides with the axis of the support hole 53 of the sub bearing 52, in the state wherein the support mechanism 54 is assembled and the engagement cap 56 supports the sub bearing 52. In other words, the axis of the support hole 53 of the sub bearing 52 coincides with the axis of the rotating body 8 and is displaced from the axis of the cylinder 7**.

The slide pin 57 is loosely inserted into the horizontal pin stopper hole **61*a*. The engagement cap 56 is rotatable about the slide pin 57. Both end portions of the slide pin 57 are supported by removal-preventing means so as not to be removed from the pin stopper 56*c***.

An insertion hole **57*a* is formed at central part of the slide pin 57. The hole 57*a* extends along a line intersecting at right angles with the axis of the slide pin 57. The insertion hole 57*a* communicates with the stopper hole 61*b*. The support pin 58 is loosely inserted through the vertical stopper hole 61*b* and insertion hole 57*a*. The slide pin 57 and the engagement cap 56 are supported so as to be rotatable about the support pin 58**.

In FIGS. 7 to 9, the support pin 58 is provided vertically. The support member 59 is formed by bending a plate member, and comprises a central base portion **59*a* and both end portions 59*b* located at both ends of the base portion 59*a* and substantially perpendicular to the base portion 59*a*. The base portion 59*a* of the support member 59 is fixed on the sealed casing 2 by means of, e.g. welding. The end portions 59*b* of the support member 59 are fixed to both end portions of the support pin 58**.

The support pin 58 and the slide pin 57 intersects at right angles in X-Y axis direction. The point of intersection of the support pin 58 and the slide pin 57 coincides with the axis of the rotating body 8, i.e. the axis of the support hole 53, since the point of intersection of the axis of the pin stopper holes **61*a* and 61*b* coincides with the axis of the support hole 53 of the sub bearing 52**.

Figure 10:
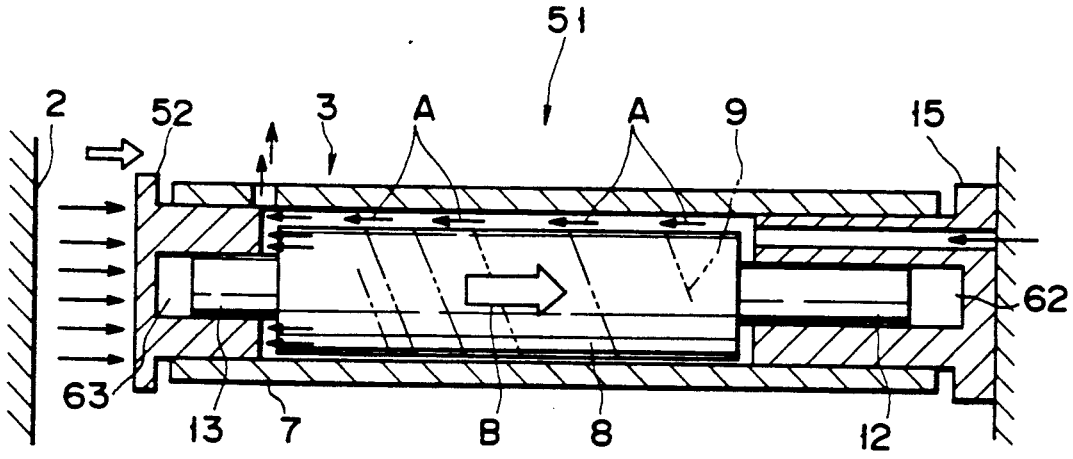
FIG. 10 is a view for explaining the function of a refrigerant gas in a compression section.

The compressor 51 compresses the refrigerant gas in the axial direction of the cylinder 7, as is indicated by arrows A in FIG. 10. A thrust force acting from the discharge side to the suction side (from the left to the right in FIG. 10) of the cylinder 4, as is indicated by an arrow B, is exerted on the rotating body 8, owing to a pressure difference between the suction pressure and the discharge pressure. The rotating body 8 is pushed to the suction side by the thrust force B.

In the compressor 51, a discharge pressure is applied to the end face of the main shaft 12 of the rotating body 8, and a suction pressure is applied to the end face of the sub shaft 13.

Pressure-application spaces 62 and 63 are formed within the main bearing 15 and the sub bearing 52. Compressed high-pressure refrigerant gas is introduced in the space 62 within the main bearing 15, and pre-compression low-pressure refrigerant gas is introduced in the space 63 within the sub bearing 52.

Thus, a discharge pressure is applied to the end face of the main shaft 12 of the rotating body 8, and a suction pressure is applied to the end face of the sub bearing 13. A force acting opposite to the thrust force B is produced, and the forces acting on the rotating body 8 are substantially balanced. Thus, the entire thrust force is set low.

In the case where discharge-pressure refrigerant gas is introduced in the main bearing 15 and suction-pressure refrigerant gas is introduced in the sub bearing 52, the forces acting on the sub bearing 9 in accordance with the pressure difference become unbalanced, and a force acting towards the main bearing 15 may be exerted on the sub bearing 52.

Since the compressed refrigerant gas is discharged from the discharge side into the sealed casing 2, the pressure within the sealed casing 2 becomes substantially equal to the pressure of the discharged refrigerant gas. Consequently, the outer end face of the sub bearing 52, which is exposed to the inside of the sealed casing 2, is pushed. Since the inner end face of the sub bearing 52 is eccentric, the force acting on the eccentric end face varies in the circumferential direction. This is why the force acting towards the main bearing 15 is exerted on the sub bearing 52.

The above-described compressor 51 is provided with the support mechanism 54. The sub bearing 52, along with the rotating body 8 and cylinder 7, is supported by the slide pin 57 and the support 58. The sub bearing 52 is supported so as to be movable in the X-Y directions and rotatable. The point of intersection between the slide pin 57 and the support pin 58 coincides with the axis of the rotating body 8.

While the thrust force B is exerted on the rotating body 8 from the sub bearing (52) side to the main bearing (15) side owing to the compression of the refrigerant gas, the discharge pressure is applied to the end face of the main shaft 12 of the rotating body 8, which end face is open to the pressure-application space 62, and the suction pressure is applied to the end face of the sub shaft 13, which end face is open to the pressure-application space 63. Thus, the force acting opposite to the thrust force B is exerted on the rotating body 8.

The sealed casing 2 is filled with the compressed high-pressure discharge gas, which acts on the outer end face of the sub bearing 52 and the support mechanism 54. Since the eccentric support hole 53 is formed in the sub bearing 52, the inner end face of the sub bearing 52 receives different pressures along the circumferential direction. Thus, the sub bearing 52 always receives irregular, unbalanced pressure.

However, the support mechanism 54, which is interposed between the sub bearing 52 and the sealed casing 2, prevents the sub bearing 52 from being displaced towards the main bearing 15. The sub bearing 52 is not put in slidable contact with the rotating body 8 and the cylinder 7, and frictional loss of the sub bearing 52 is prevented.

The sub bearing 52 is supported by the slide pin 57 and the support pin 58, which cross each other at right angles and constitute the support mechanism 54, such that the sub bearing 52 is movable along lines of radial directions which intersect each other at right angles. Thus, the sub bearing 52 is suitably supported so as to cancel a displacement in all directions on a plane.

In addition, the sub bearing 52 is rotatable in circumferential directions of the slide pin 57 and the support pin 58. The point of intersection of the slide pin 57 and the support pin 58 coincides with the axis of the rotating body 8. Thus, when the sub bearing 52 receives an unbalanced force and is inclined, the sub bearing 52 freely rotates along the circumferences of the pins 57 and 58.

Therefore, even if the squareness of the sub bearing 52 in relation to the support mechanism 54 is not maintained owing to the precision of parts or the assembly of the compressor, the sub bearing 52 is inclined and the cylinder 7, etc. follow the movement of the sub bearing 52. Thus, no lateral pressure occurs between the sub bearing 52 and the cylinder 7, etc.

The displacement angle of the sub bearing 52 is indicated by $\theta$ 1 in FIG. 7.

Since the sub bearing 5 is prevented by the support mechanism 54 from rotating about its own axis, the function of the sub bearing 52 is not lost.

Figure 11:
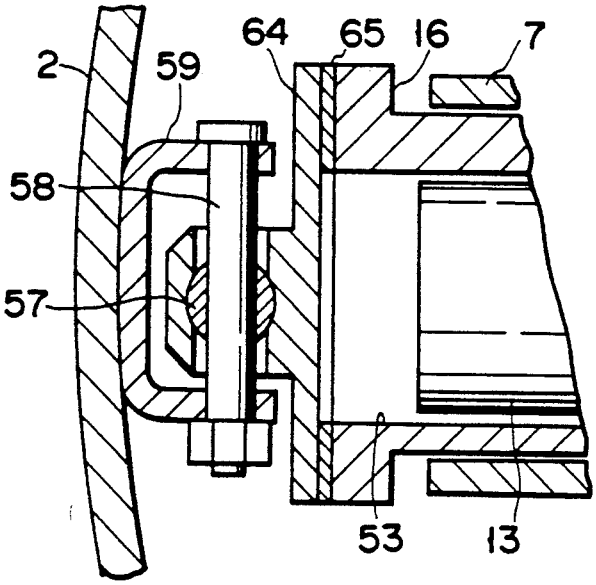
FIG. 11 is a cross-sectional side view showing the sub bearing, the support mechanism and the peripheral parts in the third embodiment in which an 0-ring is replaced by a packing.

In the third embodiment, the 0-ring 60 is used as a seal member situated between the engagement cap 56 of the support mechanism 54 and the support hoe 53 in the sub bearing 52. This invention is not limited to this example. For example, as is shown in FIG. 11, a plate-like packing 65 may be interposed between the end face of an engagement cap 64 and the outer end face of the sub bearing 52.

In addition, in the third embodiment, the slide pin 57 is supported by the engagement cap 56, the support pin 58 is supported by the support member 59, and the slide pin 57 and the support pin 58 are engaged so as to cross each other at right angles. This invention is not limited to this example. For example, the slide pin 57 may be provided directly on the sub bearing 53, and the support pin 58 may be provided directly on the sealed casing 2. It is not necessary to directly engage the pins 57 and 58. The pins 57 and 58 may be situated apart from each other so as to cross each other at right angles.

Figure 12:
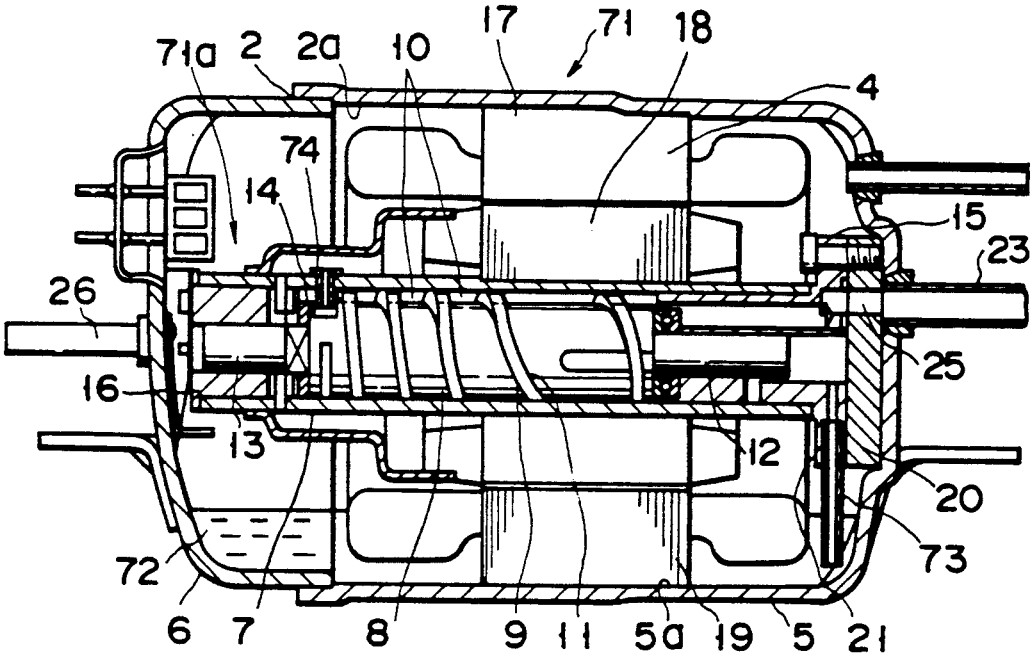
FIG. 12 is a cross sectional side view showing a fourth embodiment of the invention.

FIG. 12 shows a fourth embodiment of the invention. The structural elements, which have already mentioned in the above embodiments, are denoted by like reference numerals, and the description thereof is omitted.

In FIG. 12, numeral 71 denotes a sealed type fluid compressor (hereinafter referred to as "compressor"). Numeral 71*a* denotes a compression section provided in the compressor 71 and housed in a sealed casing 2. The compression section 71*a* comprises a cylinder 7 and a columnar cylinder 8 situated eccentrically within the cylinder 7.

A spiral blade 9 is fitted in a spiral groove 11 formed in the outer peripheral surface of the rotating body 8. The blade 9 can freely project from and sink in the groove 11, for example, in the radial direction of the rotating body 8. The rotating body 8 has a sub shaft 13 located on the discharge side of the cylinder 7. The sub shaft 13 is inserted into a sub bearing 16 which seals the suction-side end of the cylinder 7.

The sealed casing 2 is filled with a lubricant 72. The lubricant 72 is supplied to the compression section 71*a* through a lubricant suck-up pipe 73 serving as a lubricant path connected to a main bearing 15. The lubricant 72 enters the cylinder 7 from the suction side to the discharge side, thereby lubricating slidable parts of the compression section 71*a*.

Figure 13:
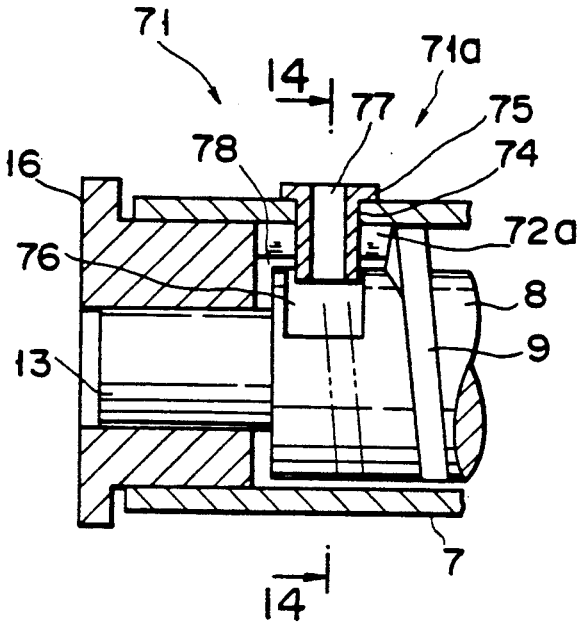
FIG. 13 is a cross-sectional side view showing a discharge side of a cylinder in the fourth embodiment.
Figure 14:
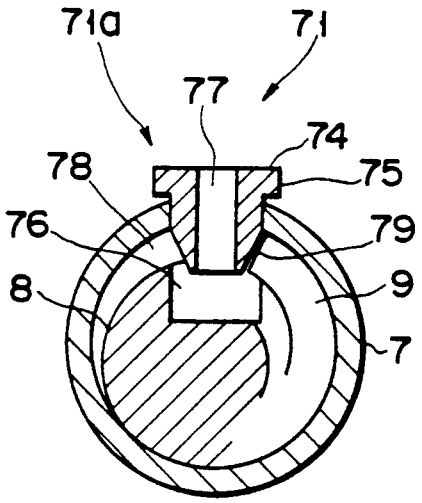
FIG. 14 is a cross-sectional view taken along line XIV—XIV in FIG. 13.

In FIGS. 12 to 14, numeral 74 denotes a blade stopper. For example, the blade stopper 74 has a cylindrical shape. The blade stopper 74 has a flange 75 at one axial end. The stopper 74 is situated on the discharge side of the cylinder 7 and is hermetically inserted in the cylinder 7. The flange 75 of the blade stopper 74 is engaged with the outer peripheral surface of the cylinder 7. The blade stopper 74 extends radially of the cylinder 7 and projects into the inside of the cylinder 7.

The flange 75 functions as a stopper and the blade stopper 74 is positioned by the flange 75. Thus, the length of that part of the blade stopper 74 which projects into the cylinder 7 is made constant.

An end portion of the blade stopper 74 is put in a recess 76 formed in the outer peripheral surface of the rotating body 8 on the discharge side. The blade stopper 74 has a discharge port 77 extending along the axis of the stopper 74. The outside of the cylinder 7 communicates with a discharge chamber 78 in the cylinder 7 through the discharge port 77.

The discharge chamber 78 is one of working chambers 10 formed along the axis of the cylinder 7. The chamber 78 is closest to the discharge side. The discharge chamber 78 is filled with high-pressure refrigerant gas (working fluid) which is compressed while being carried gradually from the suction side towards the discharge side of the cylinder 7.

The blade stopper 74 allows the high-pressure refrigerant gas compressed in the cylinder and carried to the discharge chamber 78 to path through the discharge port 77. Thus, the gas is discharged from the cylinder 7 into the inside space of the sealed casing 2.

The length of that part of the blade stopper 74, which projects into the cylinder 7, is greater than, for example, the thickness of lubricant 72*a* which is supplied into the discharge chamber 78 and is pushed on the inner peripheral surface of the cylinder 7 owing to a centrifugal force produced by the rotation of the cylinder 7.

The blade stopper 74 is located in the vicinity of the discharge-side end of the blade 9. That part of the blade stopper 74, which projects into the cylinder 7 and is opposed to the discharge-side end face of the blade 9, has an engagement surface 79. The engagement surface 79 has a shape and a size corresponding substantially to the discharge-side end face of the blade 9. The engagement surface 79 can be put in surface contact with the discharge-side end face of the blade 9, as shown in FIG. 14.

In the compressor 71 having the blade stopper 74, when the blade 9 is urged towards the discharge side along the groove 11 by the force due to relative movement between the blade 9 and the rotating body 8, the discharge-side end face of the blade 9 abuts on the engagement surface 79 of the blade stopper 74. The force acting on the blade 9 is absorbed by the blade stopper 74, and the displacement of the blade 9 is prevented.

Thus, the movement of the blade 9 towards the discharge side is prevented and also the contact between the end portion of the blade 9 and the end portion of the groove 11 of the rotating body 8 is prevented. Consequently, the abrasion of the blade 9 due to movement is prevented.

In addition, the blade stopper 74 has the discharge port 77 and is projected into the cylinder 2. Thus, all lubricant 72*a* supplied to the discharge chamber 78 is not discharged through the discharge port 77, and a suitable amount of lubricant is always kept in the cylinder 7. The blade stopper 9 serves to discharge refrigerant gas and also to maintain lubricant, and the prevention of movement of the blade and the maintaining of lubricant can be effected by a single part.

Figure 15:
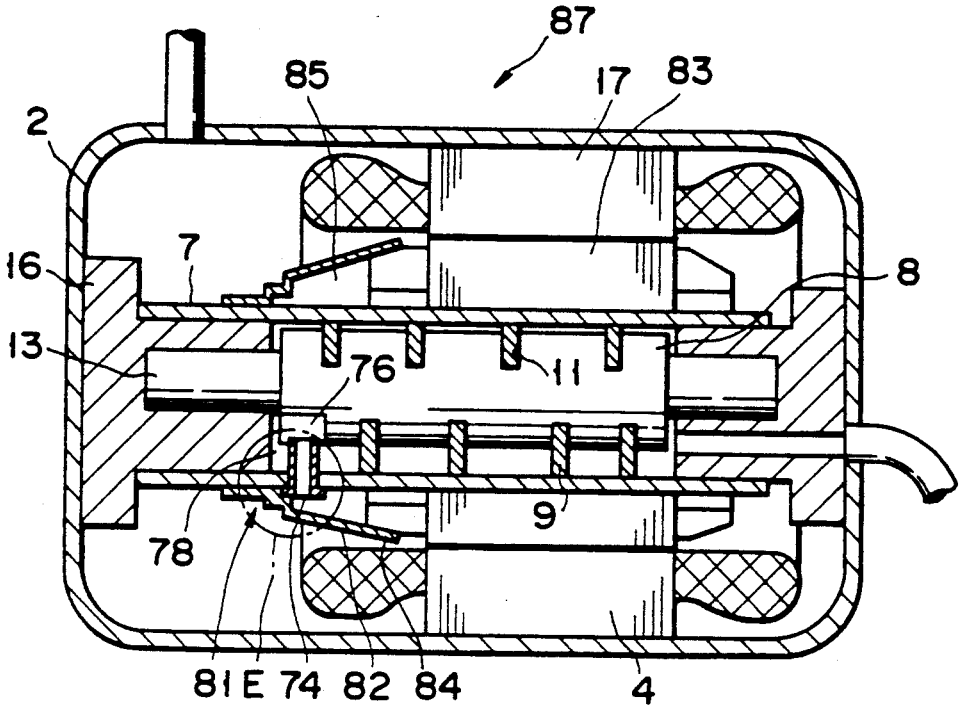
FIG. 15 is a cross-sectional side view showing a fifth embodiment of the invention.

FIG. 15 shows a fifth embodiment of the present invention. The structural elements, which have already been mentioned in the above embodiments, are denoted by like reference numerals and the description thereof is omitted.

In FIG. 15, numeral 81 denotes a discharge muffler (hereinafter called "muffler") serving as a surrounding body. The muffler 81 has a cylindrical shape and is coaxially mounted on the discharge-side part of a cylinder 7. One axial end portion of the muffler 81 is put in hermetical contact with the outer peripheral surface of the cylinder 7.

The muffler 81 has a tapered portion 82 flaring gradually towards the suction side of the cylinder 7. The other axial end portion of the muffler 81 reaches a motor rotor 83 mounted on the cylinder 7 and is hermetically connected to a tapered surface 84 of the rotor 83. A hermetically closed space 85 is formed between the inner peripheral surface of the muffler 81 and the outer peripheral surface of the cylinder 7.

Figure 16:
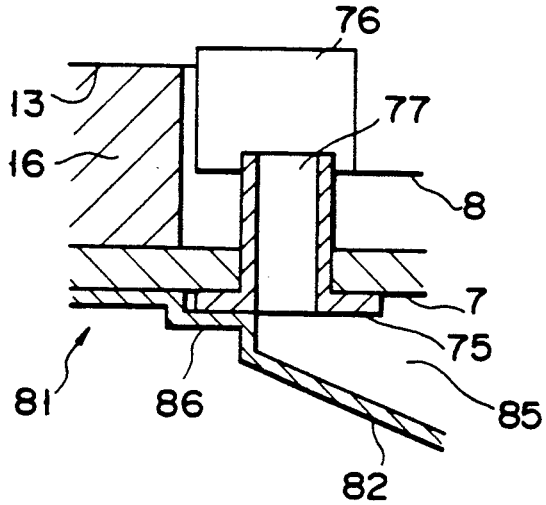
FIG. 16 is an enlarged view of that part in FIG. 15 which is indicated by a circle E.

A blade stopper 74 is situated within the muffler 81, and a discharge port 77 of the stopper 74 communicates with the space 85. As is shown in FIG. 16, the muffler 81 has a stepped portion at its intermediate portion in the axial direction. The stepped portion serves as a blade stopper fixing portion (hereinafter called "fixing portion") 86.

The fixing portion 86 of the muffler 81 is partly overlapped with a flange 75 of the blade stopper 74. The flange 75 is clamped between the fixing portion 86 and the outer peripheral surface of the cylinder 7. Thus, the muffler 86 presses and fixes the blade stopper 74 on the cylinder 7.

The muffler 81 rotates along with the cylinder 7 and the rotor 83 which constitutes a drive motor 4. The high-pressure refrigerant gas (or working fluid), which is carried and compressed in the cylinder 7, sent to the discharge chamber 78 and passed through the discharge port 77, is discharged into the closed space 85 in the muffler 81.

The muffler 81 attenuates the noise of refrigerant gas discharged to the closed space 85 in a pulsating manner, by reflecting and re-reflecting the noise in the inside of the muffler 81. Then, the high-pressure refrigerant gas is passed through a hole (not shown) formed at a predetermined location on the wall of the muffler 81 and is discharged into the sealed casing 2.

In FIG. 15, numeral 17 denotes a motor stator which, in combination with the rotor 83, constitutes the drive motor 4.

In the compressor 87 having the muffler 81, the muffler 81 attenuates the noise (e.g. pulsating sound) of the refrigerant gas discharged from the cylinder 7.

As a method of fixing the blade stopper 74 to the cylinder 7, forcible fitting or adhesion may be considered in addition to the above-mentioned method. If the blade stopper 74 is forcibly fitted in the cylinder 7 with too strong force, the blade stopper 74 may be deformed. On the other hand, if the stopper 74 is fitted in the cylinder 7 with too weak force, the stopper 74 may be removed from the cylinder 7 owing to centrifugal force.

If the blade stopper 74 is adhered to the cylinder 7, the reliability of adhesion cannot be ensured for a long time.

In the above-described compressor 87, the blade stopper 74 is pressed on the cylinder 7 by making use of part of the muffler 81. Thus, the blade stopper 74 can be surely fixed. The blade stopper 74 can be fixed without forcible fitting or adhesion. The removal of the blade stopper 74 can be prevented and highly reliable fixation of the stopper 74 can be ensured for a long time.

Since the blade stopper 74 can be fixed only by mounting the muffler 81 on the cylinder 7, the fixation of the blade stopper 74 is very easy.

A sixth embodiment of the invention will now be described with reference to FIGS. 17 to 25. The structural elements, which have already been mentioned in the above embodiments, are denoted by like reference numerals.

Figure 17:
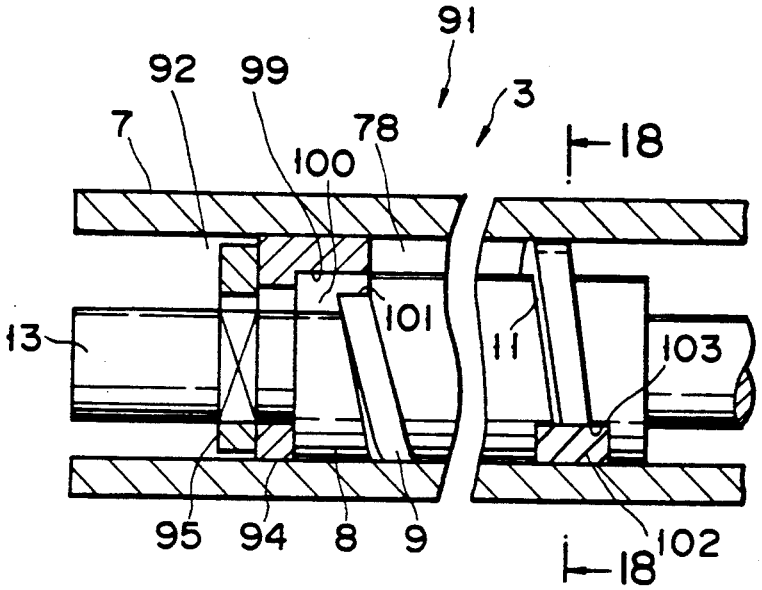
FIG. 17 is a cross-sectional side view showing a compression section according to a sixth embodiment.
Figure 18:
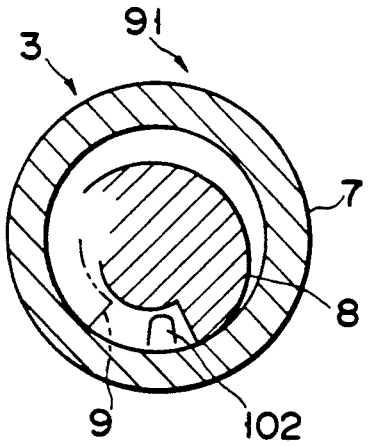
FIG. 18 is a cross-sectional view taken along line XVIII—XVIII in FIG. 17.
Figure 19:
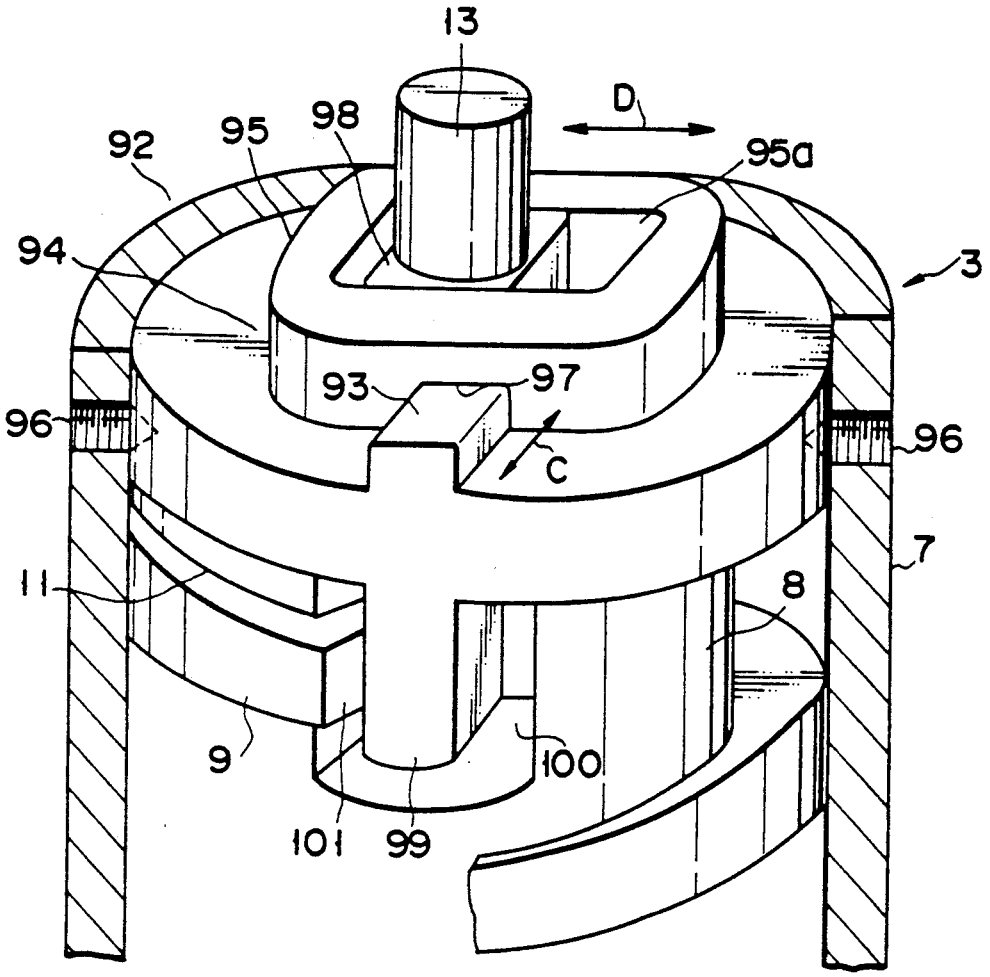
FIG. 19 is a perspective view of a cut-out part including an Oldham mechanism and its peripheral portion.
Figure 20:
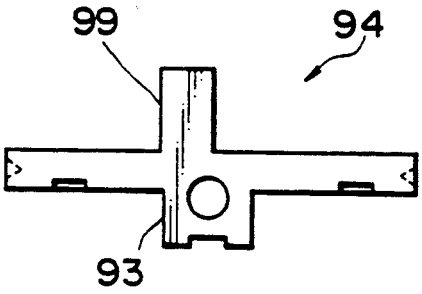
FIG. 20 is a front view of a fixed-side Oldham mechanism.
Figure 21:
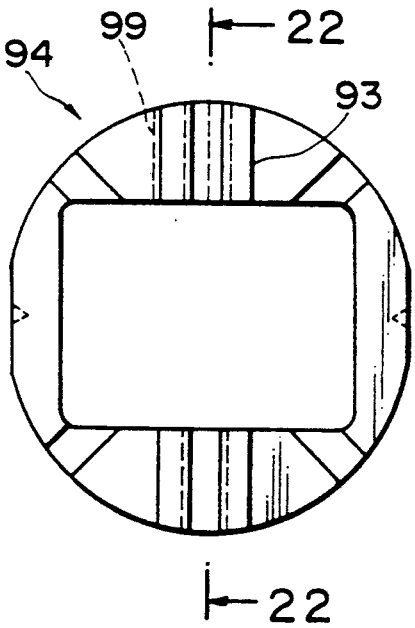
FIG. 21 is a plan view of the fixed-side Oldham mechanism.
Figure 22:
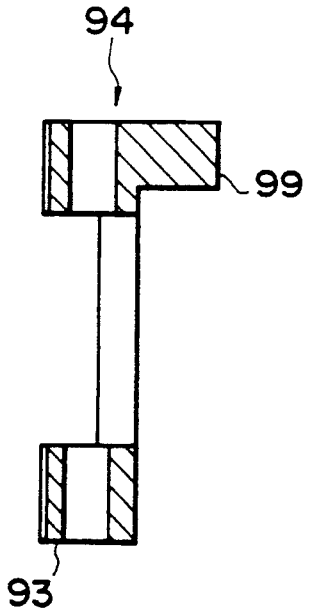
FIG. 22 is a cross-sectional view taken along line XXII—XXII in FIG. 21.
Figure 23:
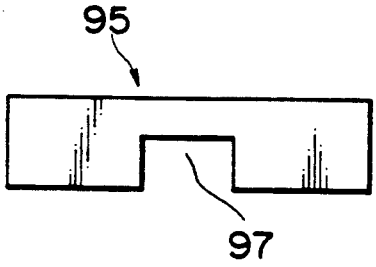
FIG. 23 is a front view of an Oldham ring.
Figure 24:
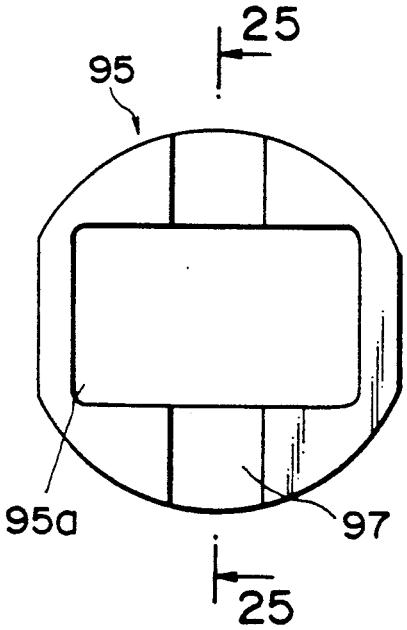
FIG. 24 is a plan view showing the Oldham ring.
Figure 25:
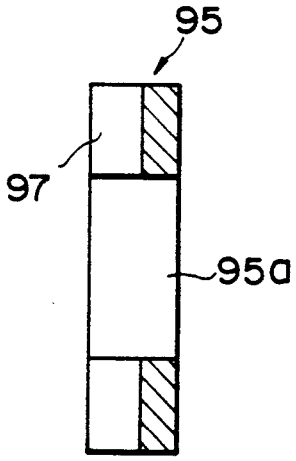
FIG. 25 is a cross-sectional view taken along line XXV—XXV in FIG. 24.

In FIGS. 17 to 19, numeral 91 denotes a sealed type fluid compressor used, for example, in a refrigerating cycle. Numeral 3 denote a compression section provided in the compressor 91 and stored in a sealed casing (not shown).

In FIGS. 17 to 19, numeral 92 denotes an Oldham mechanism situated on the discharge side of a cylinder 7. The Oldham mechanism 92 comprises a disc-shaped fixed Oldham member 94 having a key 93 on the discharge-side side surface, and an Oldham ring 95 situated along the discharge-side side surface of the fixed Oldham member 94 and having a rectangular ring hole 95*a*.

The fixed Oldham member 94 is secured to the cylinder 7 by means of fixing screws 96 inserted in the radial direction of the cylinder 7. In addition, the key 93 of the fixed Oldham member 94 is engaged in a key groove 97 of the Oldham ring 95. A sub shaft 13 of a rotating body 8 is passed through the fixed Oldham member 94 and the Oldham ring 95. An engagement portion 98 of the sub shaft 13, which has a rectangular cross section, is engaged in the ring hole 95*a* in the Oldham ring 95.

The Oldham mechanism 92 is operated in the following manner. The Oldham ring 95 is slid over the fixed Oldham member 94 in the direction of arrow C, and the rotating body 8 is slid in the direction of arrow D relative to the Oldham ring 95. Thereby, for example, the torque of the cylinder 7 is transmitted to the rotating body 8, and the cylinder 7 and rotating body 8 are synchronously rotated relative to each other.

The Oldham mechanism 92 has a first blade stopper (hereinafter called "first stopper") 99. The first stopper 99 has a prismal shape and projects from the suction-side surface of the fixed Oldham member 94. The first stopper 99 is located at the outer peripheral portion of the fixed Oldham member 94 and on that side of the fixed Oldham member 94 which is opposite to the side where the key 93 is provided.

The first stopper 99 is put in a discharge-side recess 100 formed on the discharge side of the rotating body 8 so as to open at the end face and peripheral face of the rotating body 8. The first stopper 99 faces a discharge-side end portion of a blade 9 projecting into the recess 100. As is shown in FIG. 19, one side face of the stopper 99 abuts on a discharge-side end face 101 of the blade 9.

In FIG. 17, numeral 102 denotes a second blade stopper (hereinafter, called "second stopper"). The second stopper 102 is provided on the suction side of the cylinder 7 and projects radially from the inner peripheral surface of the cylinder 7. The second stopper 102 is put in a suction-side recess 103 formed at the suction side of the rotating body 8. The recess 103 is open at the outer peripheral surface of the rotating body 8. The second stopper 102 faces a suction-side end portion of the blade 9, which reaches the recess 103, and abuts on the suction-side end portion of the blade 9.

Clearances large enough to prevent mutual contact of the cylinder 7 and rotating body 8 during relative rotation are provided between the outer peripheral surface of the first stopper 99 and the wall of the discharge-side recess 100 and between the outer peripheral surface of the second stopper 102 and the wall of the suction-side recess 103.

In this compressor 91, when the blade 9 tends to move in the spiral groove 11, owing to the force occurring by relative movement of the rotating body 8 and blade 9, the pressure difference between the suction pressure and discharge pressure of refrigerant gas, the temperature of the cylinder 8 and the friction between the rotating body 8 and blade 9, one of the end portions of the blade 9 is brought into contact with the first stopper 99 or second stopper 102. Thus, the first stopper 99 or second stopper 102 absorbs the force acting on the blade 9.

When the blade 9 tends to move towards the discharge side, the movement of the blade 9 is prevented by the first stopper 99. When the blade 9 tends to move towards the suction side, the movement of the blade 9 is prevented by the second stopper 102.

According to this compressor 91, the movement of the blade 9 towards the discharge side and suction side can be prevented, and the contact between the end portions of the blade 9 and the end portions of the groove 11 in the rotating body 8 can be prevented. Accordingly, the abrasion of the blade 9 due to movement thereof can be prevented. In this embodiment, the movement of the blade 9 not only towards the discharge side but also towards the suction side can be prevented. Thus, higher durability and reliability can be ensured, compared to a compressor wherein the movement of blade 9 only towards the discharge side is prevented.

The torque of the cylinder 7 and rotating body 8 is transmitted by means of the Oldham mechanism 92, and the first and second stoppers 99 and 102 are not used to transmit this torque. Thus, excessive load is not applied to the stoppers 99 and 102. This also enhances the reliability of the compressor 91.

Furthermore, since the first stopper 99 is formed integral with the fixed Oldham member 94 of the Oldham mechanism 92, the movement of the blade 9 towards the discharge side can be prevented without increasing the number of parts.

In the sixth embodiment, the Oldham mechanism 92 is provided on the discharge side of the cylinder 7. This invention is not limited to this example. For instance, the Oldham mechanism 92 may be provided on the suction side of the cylinder 7 and the movement of the blade 9 towards the suction side may be prevented by the first stopper 99.

Figure 26:
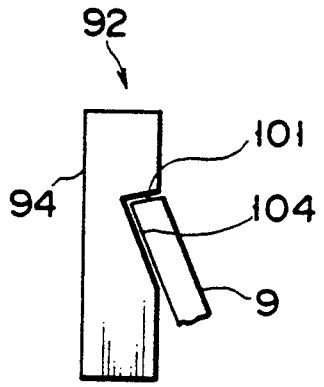
FIG. 26 is a side view showing the state wherein a blade in the sixth embodiment is engaged with the fixed-side Oldham mechanism.

In this embodiment, the movement of the blade 9 is prevented by the projecting first stopper 99. For example, it is also possible that, as shown in FIG. 26, a recess 104 is formed in the side surface of the Oldham mechanism 92 and an end portion of the blade 9 is engaged in the recess 104, thereby preventing movement of blade 9.

Figure 27:
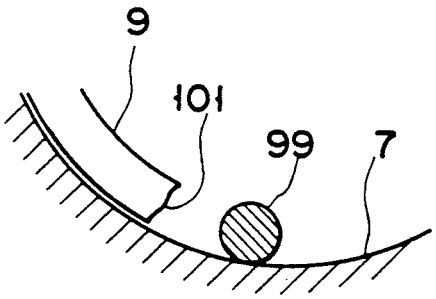
FIG. 27 is a cross-sectional view showing the shapes of a blade and a first blade stopper according to the sixth embodiment.
Figure 28:
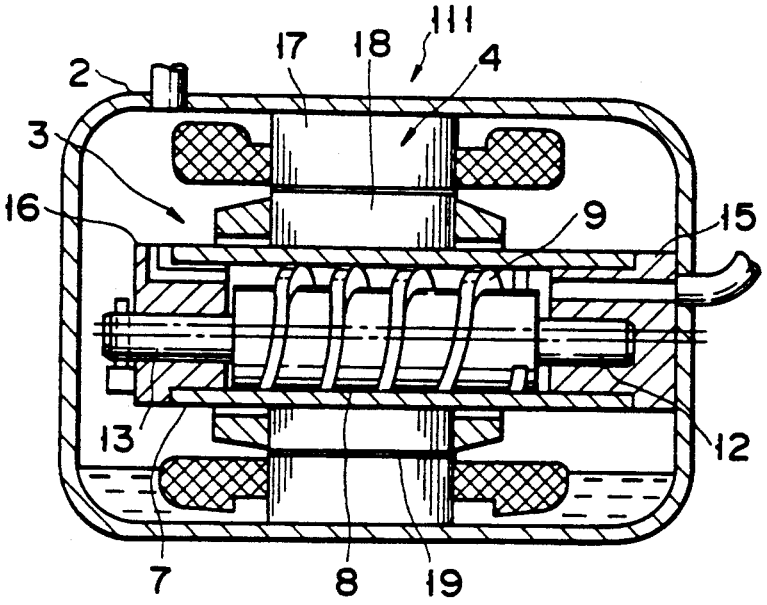
(PRIOR ART) FIG. 28
FIGS. 28 to 30 are cross-sectional side views showing prior art.
Figure 29:
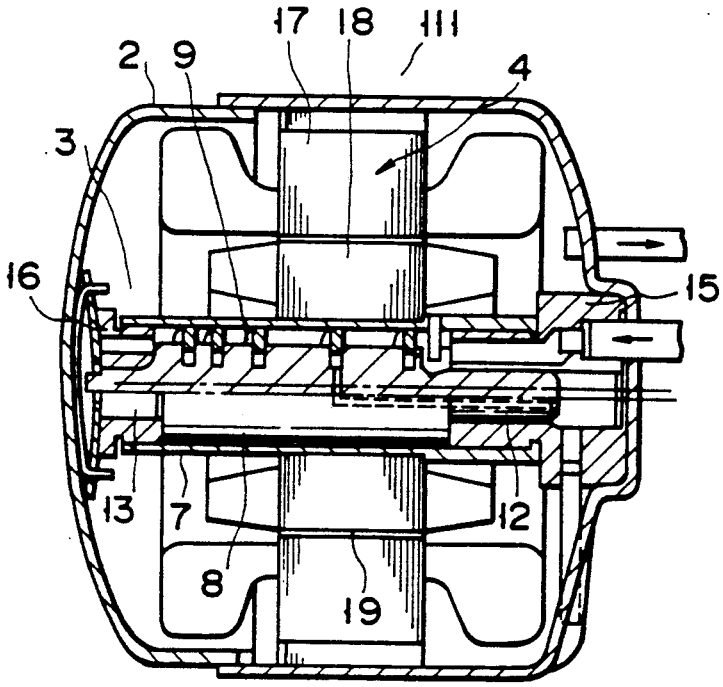
(PRIOR ART) FIG. 29

The end faces of the blade 9 and the side faces of the stoppers 99 and 102 may not necessarily be flat. For instance, as shown in FIG. 27, these faces may be curved. It is desirable that the end faces of the blade 9 and the side faces of the stoppers 99 and 102 have mutually mating shapes in order to ensure good surface contact.

The compressors of the present invention are applicable to various systems other than the refrigeration cycle.

Various modifications may be made within the scope of the subject matter of the present invention.

What is claimed is:

1. An axial flow fluid compressor comprising:

a casing;

a cylinder situated within the casing and having axial end portions, one of the end portions serving as a suction-side end portion and the other serving as a discharge-side end portion;

a rotating body having on its outer peripheral surface a spiral groove formed with a gradually decreasing pitch, the rotating body being situated eccentrically within the cylinder;

a spiral blade fitted in said spiral groove and wound around said rotating body, the spiral blade having an outer peripheral surface put in contact with an inner peripheral surface put in contact with an inner peripheral surface of the cylinder, and the spiral blade forming a plurality of working chambers within the cylinder, which chambers have volumes gradually decreasing from the suction side towards the discharge side;

a drive motor for rotating the cylinder and the rotating body relative to each other, the drive motor including a cylindrical stator fixed on the casing and a rotor mounted on the cylinder and situated inside the stator coaxially, with a motor air gap provided therebetween; and a bearing member engaged with one of the end portions and means for fixing the bearing member on an inner wall of the casing by a fixing member so as to determine a direction of axes of the rotor and the cylinder, said fixing member being a screw-type for finely adjusting a posture of said bearing member in accordance with the screw condition so as to keep said motor air gap at a predetermined value.

2. The compressor according to claim 1, wherein said screw-type fixing member is a bolt.

3. The compressor according to claim 1, wherein said casing is a sealed casing composed of a plurality of casing components being hermetically coupled to each other.

4. An axial flow fluid compressor according to claim 1, wherein said compressor further comprises said fixing member being fixed on said casing and said bearing member fixed on said fixing member, a plate surface of said fixing member being fixed on an axial end face of the casing along a line perpendicular to an axis of the rotating body.

5. The compressor according to claim 1, wherein said bearing member comprises a suction-side bearing member and a discharge-side bearing member both inserted into open ends of the cylinder to hermetically seal the cylinder and to support the axial end portions of the rotating body, and wherein said compressor further comprises a support mechanism including a columnar slide pin loosely inserted through the discharge-side bearing member in a radial direction of the discharge-side bearing member, and a columnar support pin fixed on the sealed casing and supporting the slide pin and the discharge-side bearing member rotatably and movably along an axis intersecting at right angles with the slide pin, said support mechanism supporting the discharge-side bearing member on the sealed casing and making the point of intersection of the slide pin and the support pin coincide with the axis of the rotating body.

6. The compressor according to claim 5, wherein said slide pin is directly coupled to said support pin.

7. The compressor according to claim 5, wherein said support mechanism comprises an engagement cap coupled to the discharge-side bearing member, a support member fixed on the casing and coupled to the engagement cap via the slide pin and the support pin, and a seal member for effecting hermetical sealing between the discharge-side bearing member and the engagement cap.

8. The compressor according to claim 1, further comprising a blade stopper situated on the discharge side of the cylinder, having a discharge port through which compressed working fluid is discharged to the outside of the cylinder, projecting into the cylinder, abutting on an end portion of the blade to position the blade, and serving both for the discharge of the working fluid and for the positioning of the blade.

9. The compressor according to claim 8, wherein those portions of the blade stopper and the blade, which are put in contact with each other, have curved surfaces.

10. The compressor according to claim 9, wherein said casing contains a lubricant, and said compressor further comprises a lubricant path through which the lubricant is sent into the cylinder, and wherein the length of that part of the blade stopper, which projects into the cylinder, is greater than the thickness of the lubricant introduced into the cylinder and urged on the inner peripheral surface of the cylinder.

11. The compressor according to claim 8, further comprising a surrounding body mounted on a discharge-side portion of the cylinder and having a closed space between the surrounding body and the outer peripheral surface of the cylinder, said closed space communicating with the discharge port of the blade stopper, part of the surrounding body being brought into contact with the blade stopper to fix the blade stopper to the cylinder.

12. The compressor according to claim 11, wherein said surrounding body is brought into hermetical contact with the outer peripheral surface of the cylinder and the outer peripheral surface of the rotor to form said closed space.

13. The compressor according to claim 1, wherein said compressor further comprises:

an Oldham mechanism for transmitting torque between the rotating rod and the cylinder, restricting the rotation of the rotating rod, and rotating the rotating rod and the cylinder synchronously and relative to each other; and two blade stoppers arranged on the suction side and discharge side of the cylinder, respectively, and brought into contact with the suction-side end portion and the discharge-side end portion of the blade to position the blade, at least one of the stoppers being formed integral with the Oldham mechanism, and wherein said bearing member comprises a suction-side bearing member and a discharge-side bearing member both inserted into open ends of the cylinder to hermetically seal the cylinder and to support the axial end portions of the rotating body.

14. The compressor according to claim 13, wherein said Oldham mechanism comprises a fixed Oldham member fixed on the cylinder, and an Oldham ring engaged with said rotating rod and said fixed Oldham member, said Oldham ring being movable relative to the fixed Oldham member in on direction and allowing the rotating rod to move along an axis intersecting at right angels with the line of the direction in which the Oldham ring moves relative to the fixed Oldham member.

15. The compressor according to claim 14, wherein said fixed Oldham member and said Oldham ring are engaged with each other by means of a key and a key groove, and said rotating rod has an engagement portion situated within the Oldham ring and engaged with the Oldham ring.

16. The compressor according to claim 13, wherein said Oldham mechanism is situated on one of the suction side and discharge side of the cylinder.

17. An axial flow fluid compressor comprising:

a casing;

a cylinder situated within the casing and having axial end portions, one of the end portions serving as a suction-side end portion and the other serving as a discharge-side end portion;

a bearing member engaged with one of the axial end portions of the cylinder;

a rotating body having on its outer peripheral surface a spiral groove formed with a gradually decreasing pitch, the rotating body being situated eccentrically within the cylinder;

a spiral blade fitted in said spiral groove end wound around said rotating body, the spiral blade having an outer peripheral surface put in contact with an inner peripheral surface of the cylinder, and the spiral blade forming a plurality of working chambers within the cylinder, which chambers have volumes gradually decreasing from the suction side towards the discharge side;

a drive motor for rotating the cylinder and the rotating body relative to each other, the drive motor including a cylindrical stator fixed on the casing and a rotor mounted on the cylinder and situated inside the stator coaxially, with a motor air gap provided therebetween;

a support member fixed on said casing; and fixing member means for fixing said bearing member on said support member, said fixing member means including a screw for finely adjusting a posture of said bearing member so as to keep said motor air gap at a pre-determined distance, said fixing member being located radially inward of said stator formed of a disc plate member, a plate surface of said support member being fixed on an axial end face of the casing along a line perpendicular to the axis of the casing to retain said motor air gap at a constant value.

18. The compressor according to claim 17, wherein a bearing member is fixed to a support member by means of a screw-type fixing member.

19. The compressor according to claim 18, wherein said screw-type fixing member is a bolt.

20. The compressor according to claim 17, wherein said casing is a sealed casing composed of a plurality of casing components having opened portions, the opened portion of the casing components being hermetically coupled to each other.

21. An axial flow fluid compressor comprising:

a casing;

a cylinder situated within the casing and having axial end portions, one of the end portions serving as a suction-side end portion and the other serving as a discharge-side end portion;

a rotating body having on its outer peripheral surface a spiral groove formed with a gradually decreasing pitch, the rotating body being situated eccentrically within the cylinder;

a spiral blade fitted in said spiral groove and wound around said rotating body, the spiral blade having an outer peripheral surface put in contact with an inner peripheral surface of the cylinder, and the spiral blade forming a plurality of working chambers within the cylinder, which chambers have volumes gradually decreasing from the suction side towards the discharge side;

a drive motor for rotating the cylinder and the rotating body relative to each other, the drive motor including a cylindrical stator fixed on the casing and a rotor mounted on the cylinder and situated inside the stator coaxially, with a motor air gap provided therebetween;

a bearing member engaged with one of the axial end portions of the cylinder and fixed on the inner wall of the casing by means of a fixing member situated radially more inward than said stator; and an Oldham mechanism for transmitting torque between the rotating rod and the cylinder, restricting the rotation of the rotating rod, and rotating the rotating rod and the cylinder synchronously and relative to each other, said Oldham mechanism having a recess for engagement with the blade, which recess is engaged with an end portion of the blade to position the blade.

* * * * *